United States Patent [19]

Cho

[11] Patent Number: 4,554,714

[45] Date of Patent: Nov. 26, 1985

[54] MOVING WEB EXPANDING AND GUIDING APPARATUS

[76] Inventor: Hideyuki Cho, c/o Toyo Machinery Co. Ltd., 4-4-19 Zuiko, Higashiyodogawa-ku, Ōsaka-shi, Japan

[21] Appl. No.: 586,990

[22] Filed: Mar. 7, 1984

[30] Foreign Application Priority Data

Mar. 11, 1983 [JP] Japan ..... 58-41090

[51] Int. Cl.[4] ..... D06C 3/06

[52] U.S. Cl. ..... 26/75; 26/105

[58] Field of Search ..... 26/74, 75, 105; 226/18, 226/19, 20

[56] References Cited

U.S. PATENT DOCUMENTS 4,224,724 9/1980 Bassani et al. ..... 26/75

4,291,441 9/1981 Bassani ..... 26/75

FOREIGN PATENT DOCUMENTS 4368 of 1877 United Kingdom ..... 26/74

OTHER PUBLICATIONS

*Floating Roll Steering Guide,* Mount Hope Data, MHTDB-FRSG 9/76, Ingalls 1M, 1976, S. W. Industries, Inc.

*Primary Examiner*—Robert R. Mackey

*Attorney, Agent, or Firm*—Larson and Taylor

[57] ABSTRACT

A moving web expanding and guiding apparatus comprises, in combination, an expander device having three screw rolls arranged side by side, and a guide device having a required number of centering rolls, wherein the intermediate screw roll is movable in a direction at right angles to the web surface and the centering rolls are tiltable in the direction which corrects the deviation of the web.

The apparatus is provided with a screw roll emergency stop mechanism for quickly stopping the rotation of the screw rolls when the moving web excessively zigzag deviates, and a centering roll time delay stop mechanism for stopping the operation of a centering roll tilting mechanism when the centering rolls have returned to their neutral position.

3 Claims, 8 Drawing Figures

MOVING WEB EXPANDING AND GUIDING APPARATUS

BACKGROUND OF THE INVENTION

The present invention relates to a moving web expanding and guiding apparatus and more particularly it relates to improvements in an apparatus wherein various webs such as woven fabrics, knitted fabrics, paper, and films are prevented by the expanding action of an expander device from becoming rolled at the selvages, wrinkled, or contracted during their movement and zigzag deviation of moving webs is corrected by the centering action of a guide device.

Conventionally, such moving web expanding and guiding apparatus, as disclosed for example in U.S. Pat. No. 4,224,724, is of the type comprising, in combination, an expander device having at least two expanding screw rolls diposed parallel to each other, of which one screw roll is designed so that the amount of its push-in with respect to the moving web is adjustable so as to adjust the amount of expansion of the web, and a guide device having at least two centering rolls disposed parallel to each other and designed so that when the moving web deviates, the centering rolls are tilted in the direction which corrects the deviation of the web.

In the aforesaid apparatus, however, the expanding action of the screw rolls is still insufficient and there is a serious drawback that even if the moving web excessively zigzag deviates to one side for one cause or another to the extent of causing the guide device to reach the limit of its deviation correcting action, it is impossible to prevent the moving web from being caught on one end of a screw roll and damaged since the screw rolls are designed to continue to be rotated by a motor.

Further, when the moving web excessively zigzag deviates to one side to the extent of causing the guide device to reach the limit of its deviation correcting action, as described above, the position of the centering rolls is such that they are greatly tilted to the limit position, and since the centering rolls are designed so that they are stopped at such limit tilted position, much labor and time are required to restore the deviated web to its normal position by hand before the machine can be restarted, thus producing a drawback that the machine cannot be restarted efficiently.

SUMMARY OF THE INVENTION

The present invention relates to improvements in the aforesaid moving web expanding and guiding apparatus and has for its principal object the provision of a moving web expanding and guiding apparatus capable of achieving sufficient expansion of a moving web and correction of its deviation, wherein when the moving web greatly zigzag deviates to one side for one cause or another to the extent of causing the guide device to reach the limit of its correcting action, the rotation of the expander device is quickly stopped to thereby prevent the moving web from being caught on one end of the expander device and damaged.

Another object of the invention is to provide a moving web expanding and guiding apparatus designed so that it is not until the guide device, which is now performing a maximum of its correcting action at the limit position, returns to its neutral position that the operation of said guide device is stopped, thereby making it easier to manually bring the web back to its normal position at the restart of operation so as to greatly improve the restart performance.

The present invention relates to a moving web expanding and guiding apparatus comprising an expander device having two expanding screw rolls positively rotated in the same direction by a motor and another expanding screw roll interposed between said two rolls and adapted to have the amount of its push-in adjusted and to be positively rotated by a motor in the direction opposite to that of said two screw rolls, a guide device having tiltable centering rolls rotatably installed at the web delivery side of said expanding device and a tilting mechanism, moving web selvage detectors, emergency screw roll stop means for quickly stopping the rotation of the screw rolls when the moving web excessively zigzag deviates, and centering roll time-delay stop means for stopping the operation of the centering roll tilting mechanism after the centering rolls are restored to their neutral position subsequent to the stoppage of said screw rolls.

According to the moving web expanding and guiding apparatus of the present invention arranged in the manner described above, the expander device is constructed by providing an additional expanding screw roll disposed between two expanding screw rolls positively driven in the same direction by a motor, said additional roll being adapted to have the amount of its push-in adjusted and to be positively rotated by a motor in the direction opposite to that of said two rolls, wherein the expanding rolls entrain the moving web around them to effect the expansion of the web against the movement of the web, thus making it possible to expand the moving web efficiently, while the guide device comprising the tiltable centering rolls is capable of positively correcting the deviation of the moving web.

Further, because of the arrangement wherein when the moving web zigzags to a great extent to make a considerable deviation, the rotation of the screw rolls is quickly stopped by the emergency stop means, there is an advantage that rolling of the web due to slip-off of the web, and damage to the web can be prevented.

Further, since the centering roll stop means is in the form of time delay stop means adapted to stop the centering rolls at their neutral position after they are brought back to said position subsequent to quick stoppage of the screw rolls, there is another advantage that the operation of bringing the excessively deviated web to its normal position can be easily and simply performed and the restart performance can be greatly improved.

DESCRIPTION OF THE PREFERRED EMBODIMENT

A moving web expanding and guiding apparatus according to the present invention comprises an expander device A for a moving web F, a guide device B, selvage detectors C, emergency stop means D for screw rolls, and time delay stop means E for centering rolls.

The expander device A comprises two expanding screw rolls 2 and 3 journaled and disposed parallel to each other with a required distance maintained therebetween, and an intermediate expanding screw roll 4 jounaled and disposed between said two rolls and adapted to push in the moving web surface.

Figure 4:
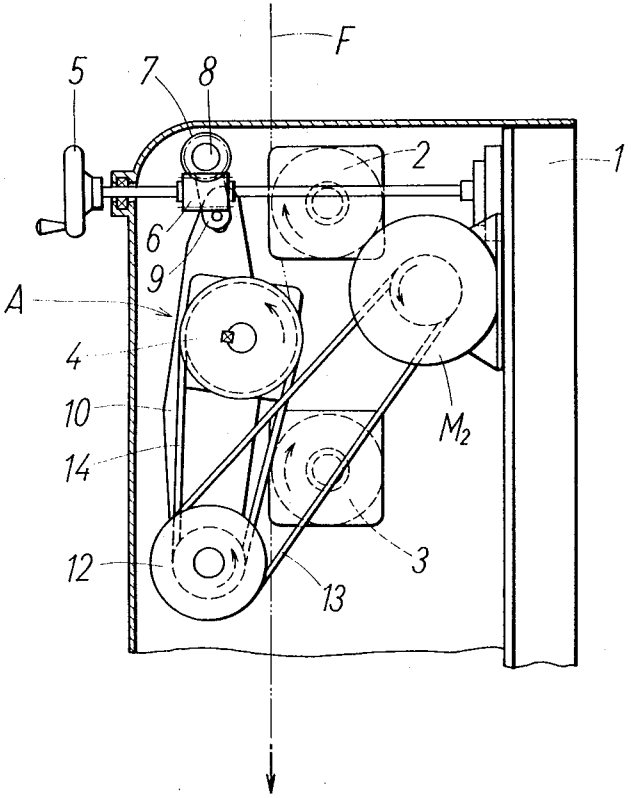
FIGS. 4 and 5 are side views showing a mechanism for adjusting the amount of push-in of an intermediate expanding roll in an expander device and its push-in adjusting action.
Figure 5:
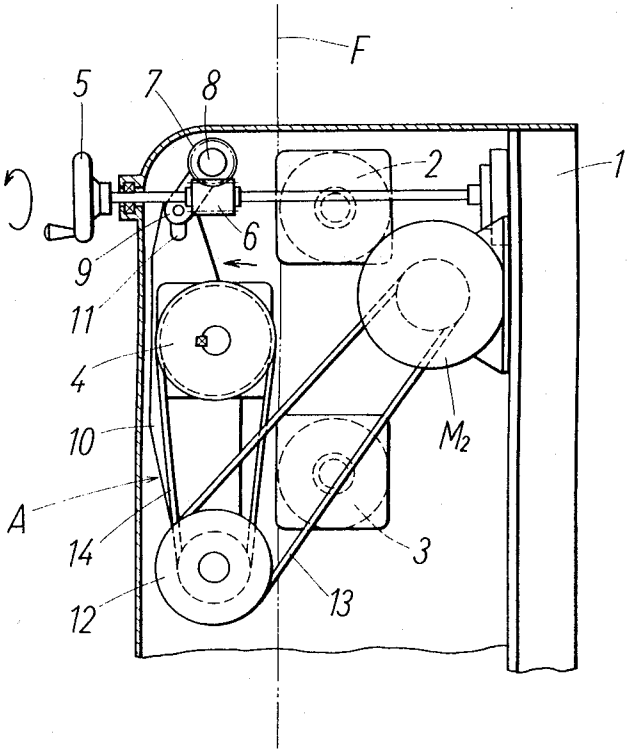

Each of the expanding screw rolls 2, 3, and 4 is provided with spiral ridges extending from the middle of the roll in the opposite directions, and these rolls are rotated by motors M1 and M2 counter to the direction of movement of the web F when the latter is entrained on the upper and lower sides of these rolls, as illustrated. The expanding screw roll 4, as shown in FIGS. 4 and 5, is arranged to be movable in a direction at right angles to the moving web surface by manipulating a handle 5 so that the amount of its push-in relative to the web can be suitably adjusted.

More particularly, when the handle 5 is rotatively manipulated, the screw roll is moved in aforesaid direction successively through a worm 6, a worm wheel 7, a counter shaft 8, and a link 9 fixed at one end thereof to said counter shaft 8 and pivotally connected at the other end to an elongated opening 11 in a support frame 10 pivotally mounted on the shaft of the screw roll 4. In FIGS. 4 and 5, the numeral 12 denotes a pulley, and 13 and 14 denote transmission belts.

The guide device B is installed at the web delivery side of said expander device A and comprises a pair of freely rotatable centering rolls 15 and a tilting mechanism 24 for said centering rolls. The tilting mechanism 24 comprises links 19 pivotally connected at one of their respective ends to bearings 16 for the centering rolls 15 through pivots 17 and at the other ends to the machine frame 1 through pivots 18, a link 23 attached at one end thereof to the pivot 18 of one link 19 and pivotally connected at the other end to a magnet-equipped movable nut 22 through an elongated opening 20 formed in said other end, said nut being threadedly engaged on a feed threaded rod 21, a reversible motor M3 for rotating said feed threaded rod 21 in one direction or the other, and limit switches S1 and S2 for stopping the motor M3 to limit the tilting of the centering rolls 15 when the link 23 reaches either stroke end in response to an excessive deviation of the moving web.

The selvage detectors C for the moving web F are disposed at the opposite lateral edges of the web, and though not shown the arrangement is such that the detection signals from said detectors are transmitted to the reversible motor M3 through known transmission means to rotate said motor forward or backward so as to tilt the centering rolls 15 in the web deviation correcting direction successively through said feed threaded rod 21, movable nut 22, and links 23 and 19, thereby correcting the deviation of the web.

The screw roll emergency stop means D are in the form of photoelectric switches disposed close to the centerline for normal movement of the moving web F and on the opposite sides of said centerline and as will be later described the arrangement is such that an excessive deviation of the moving web due its excessive zigzag movement is detected by said switches so as to stop the motors M1 and M2 through suitable transmission means to stop the rotation of the screw rolls 2, 3, and 4, thereby preventing damage to the web.

The centering roll time delay stop means E comprises the magnet-equipped movable nut 22 threadedly engaged on said feed threaded rod 21, and reed switches S3 and S4 disposed close to and intermediate between the ends of the feed threaded rod 21 (at the position of attachment of the link 23 to the feed threaded rod where the centering rolls 15 are held in their normal position). As will be later described, for ordinary stoppage as well as emergency stoppage of the centering rolls, it is not until the centering rolls are returned to their normal position that they are stopped, thereby facilitating the operation of returning the web to its normal position and the restarting operation of the machine.

Figure 6:
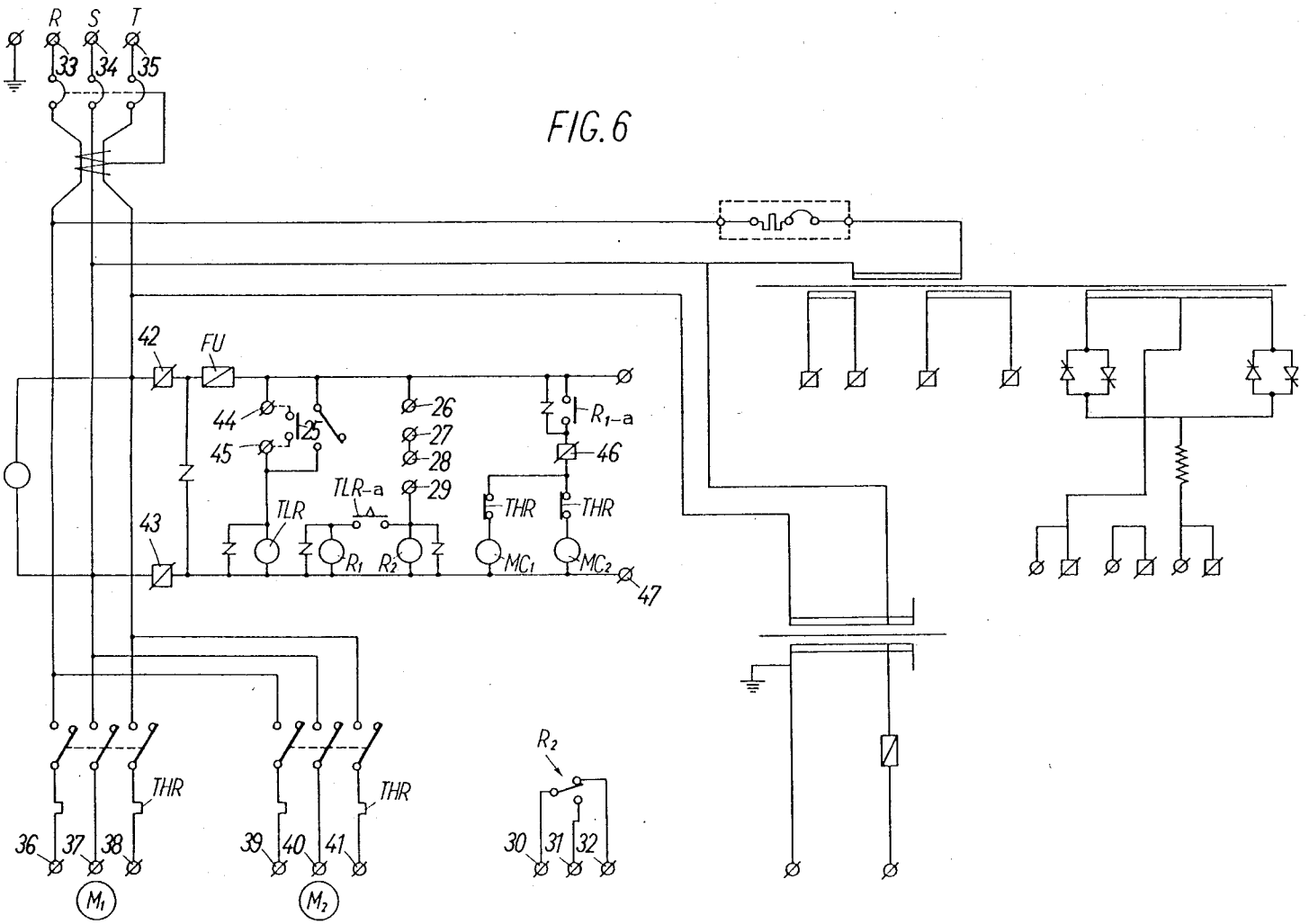
FIG. 6 is a circuit diagram showing an example of a circuit for actuating photoelectric switches which constitute expanding roll emergency stop means.
Figure 7:
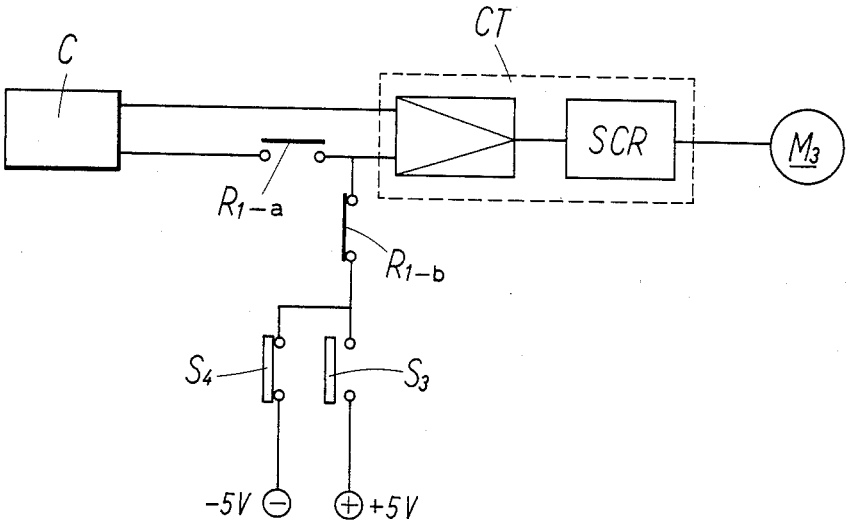
FIG. 7 is a block diagram showing a concrete example of time delay stop means for returning centering rolls to their neutral position.
Figure 8:
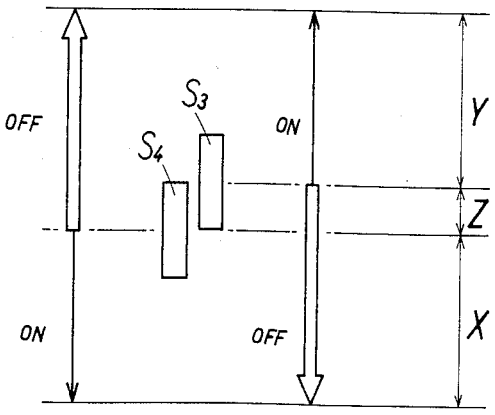
FIG. 8 is a view for explaining the time delay stop action for returning the centering rolls to their neutral position.

An example of the operation of the emergency stop means and time delay stop means will now be outlined with reference to FIGS. 6 through 8.

Figure 1:
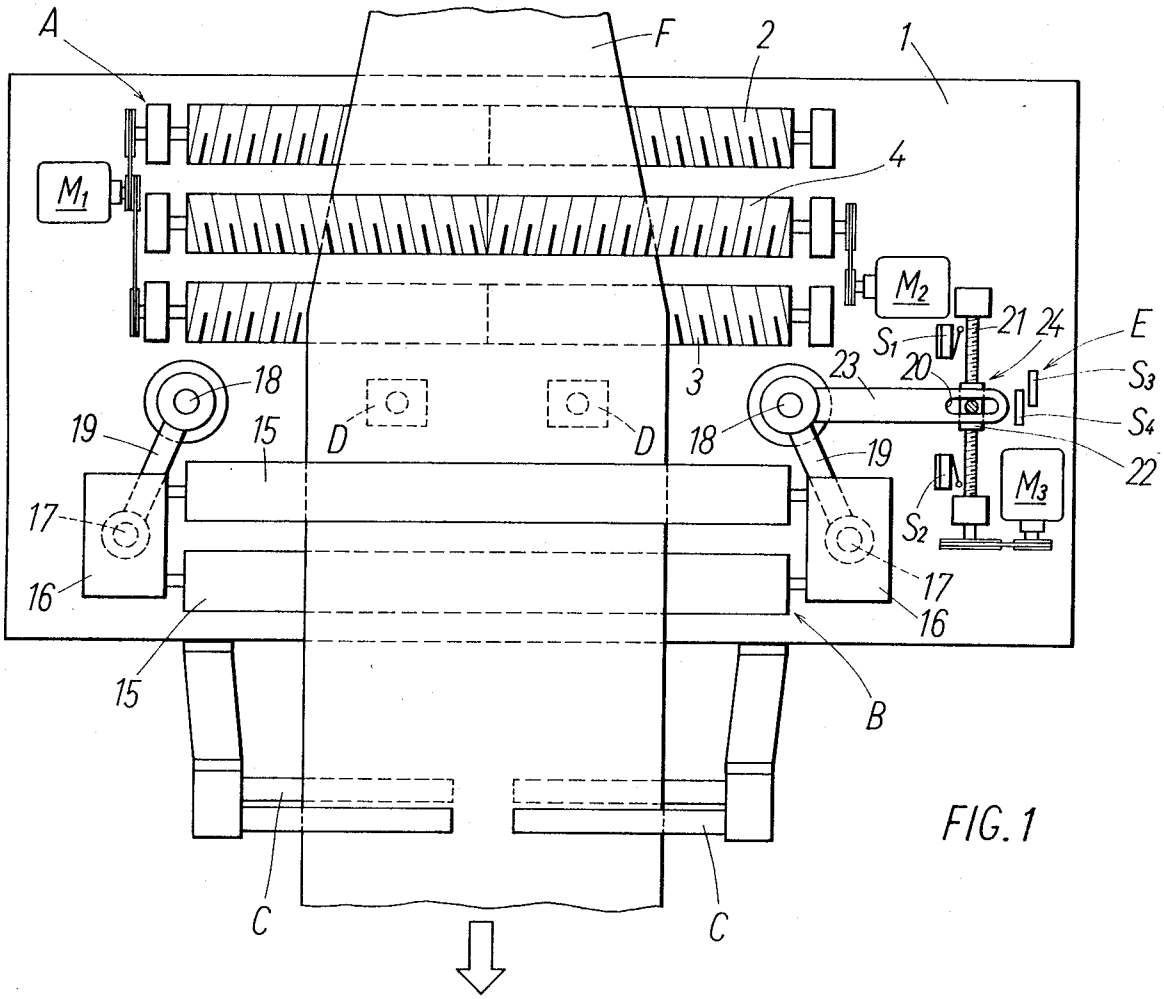
FIG. 1 is a partly omitted front view of the apparatus of the present invention wherein a moving web entrained in the apparatus is in its normal position.
Figure 2:
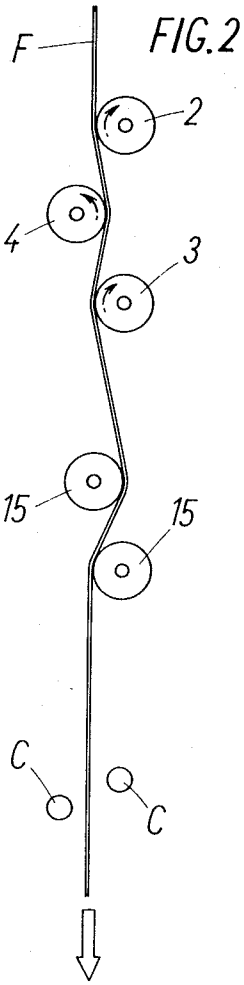
FIG. 2 is a schematic side view showing the manner of entrainment of the moving web in the apparatus of the invention and the direction of rotation of screw rolls relative to the direction of movement of the web.
Figure 3:
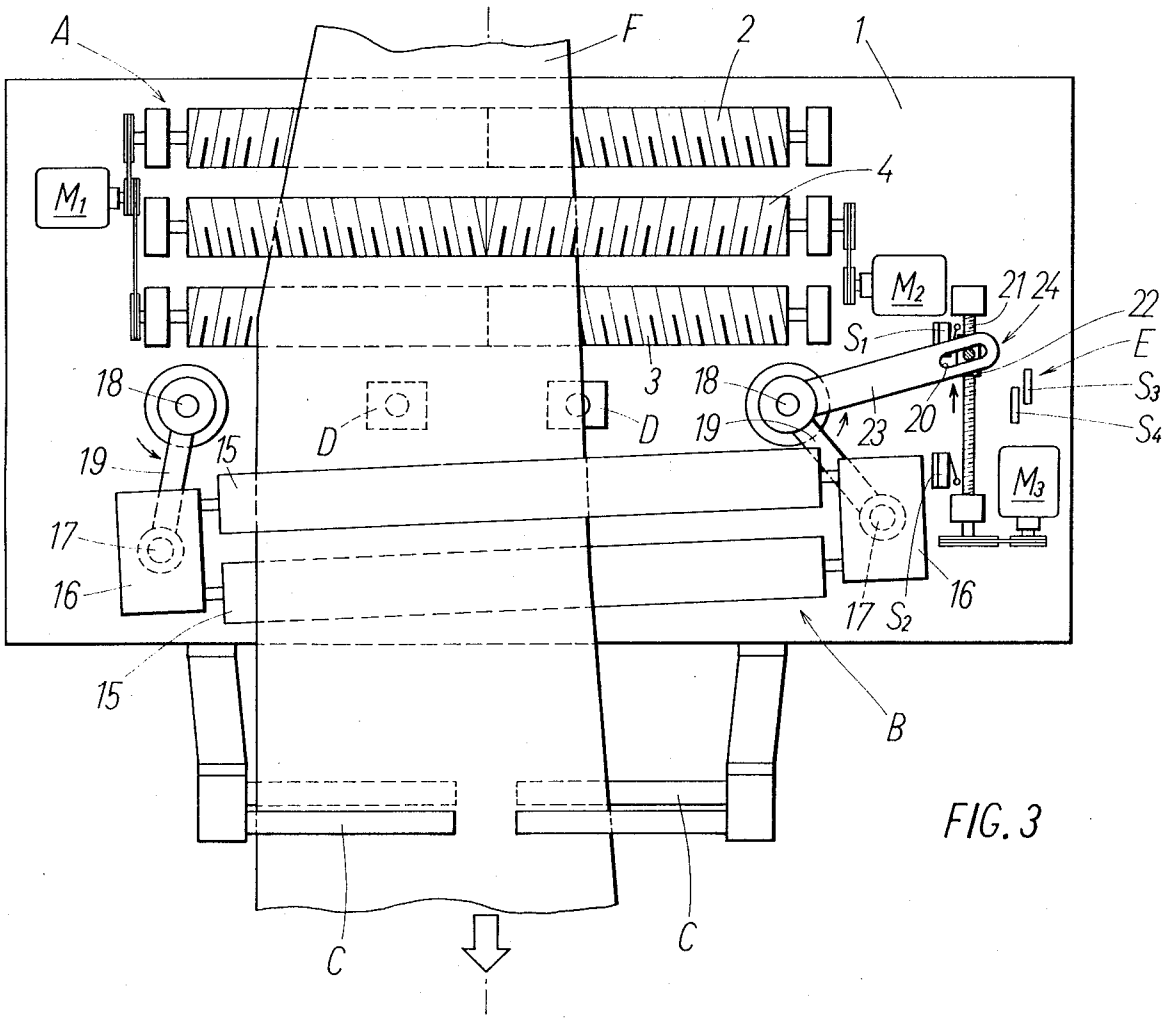
FIG. 3 is a partly omitted front view of the apparatus wherein the moving web entrained in the apparatus zigzag deviates to one side.

In the circuit diagram shown in FIG. 6, a web moving line drive source contact 25 is closed to effect line drive and energize a timer TLR, and a little time after the line drive the a contact TLR-a of said timer is closed. The contacts of the aforesaid photoelectric switches D are inserted between terminals 26 and 27 and between terminals 28 and 29, the arrangement being such that when light beams to said switches are blocked by the moving web F, the contacts of said switches remain closed and the web is moving. Then, a relay R1 is energized to close its a contact R1-a, whereby motor contactors MC1 and MC2 are energized to close their contacts, thereby rotating the drive motors M1 and M2 for the screw rolls 2, 3, and 4. A relay R2 serves to indicate the state of the photoelectric switches D; thus, terminals 30, 31, and 32 indicate whether the apparatus is in operation or whether the web excessively deviates to one side. If the web makes an excessive zigzag deviation, as shown in FIG. 3, the contact of the corresponding photoelectric switch is opened, so that the relays R1 and R2 are deenergized to cause an emergency stoppage of the motors M1 and M2.

In addition, in FIG. 6, RST denotes a three phase power source; THR denotes thermal relay-equipped switches; FU denotes a fuse; and 33–41, 44, 45, and 47 denote terminals.

The operation of time-delay stoppage of the centering rolls 15 will now be described with reference to the FIG. 6 circuit diagram, FIG. 7 block diagram, and FIG. 8 explanatory view. The a and b contacts R1-a and R1-b of the relay R1 are arranged as shown in FIGS. 6 and 7. When the relay R1 is energized, its a contact is closed while a signal from the detector C enters a PID controller CT, so that according to the contents of the signal the centering rolls 15 are suitably tilted for ordinary correcting action by means of the motor M3 and the tilting mechanism 24. Further, the stoppage of tilting movement of the centering rolls is effected by the deenergization of the relay R1, as in the above, but in this embodiment, upon deenergization of the relay R1, its b contact is closed, so that the circuit is switched to a reed switch circuit composed of memory type reed switches S3 and S4. That is, at the time of switching to said reed switch circuit, if the position of the magnet-equipped nut 22 is in a region X shown in FIG. 8, the reed switch S3 is OFF and S4 is ON, with −5 V from a DC power source being applied to the PID controller CT, so that the motor M3 is rotated in the reverse direction to move the nut 22 to a region Z (neutral position) where the two reed switches are OFF; thus, the centering rolls 15 are stopped after they have been returned to their neutral position.

On the other hand, at the time of switching to said reed switch circuit, if the position of the nut 22 is in a region Y shown in FIG. 8, the reed switch S3 is ON and S4 is OFF, with +5 V from the DC power source being applied to the PID controller CT, so that the motor M3 is rotated in the forward direction to move the nut 22 to the region X where the two reed switches are OFF, thus achieving the same return movement and stoppage as in the above. In this manner, the return movement of the guide rolls to their neutral position is reliably effected not only for emergency stoppage due to excessive zigzag deviation of the web but also for stoppage of the moving line drive source.

While a typical embodiment of the invention has been described so far, it is only by way of example and the invention is not limited thereto, it being understood that changes and modifications may be made without departing from the scope of the invention defined in the appended claims.

I claim:

1. A moving web expanding and guiding apparatus comprising:

an expander device including:

(a) two expanding screw rolls over which the moving web travels, (b) a first motor means for positively rotating said two screw rolls in the same direction, (c) a third expanding screw roll interposed between said two screw rolls, (d) means for adjusting the amount of the push-in of said third expanding screw roll relative to the moving web, and (e) a further motor means for positively rotating said third screw roll in a direction opposite to that of said two screw rolls;

a guide device including:

(a) tiltable centering rolls rotatably installed at a web delivery side of said expander device, (b) a tilting means for tilting said centering rolls, and (c) moving web selvage detector means for detecting deviations of the moving web and for actuating said tilting means to correct this deviation;

emergency screw roll stop means for quickly stopping the rotation of said screw rolls when the moving web excessively zigzag deviates; and centering roll time-delay stop means for stopping the operation of said centering roll tilting means after the centering rolls are restored to a neutral position subsequent to the stoppage of said screw rolls.

2. A moving web expanding and guiding apparatus as set forth in claim 1 wherein said emergency stop means for the screw rolls includes photoelectric switches disposed close to the centerline for the normal movement of the moving web and on the opposite sides of said centerline.

3. A moving web expanding and guiding apparatus as set forth in claim 1 wherein said centering roll tilting means includes a tilting link member attached at one end to said centering rolls and having an opposite end; and wherein said time delay stop means for the centering rolls comprises a magnet-equipped movable nut attached to the opposite end of said tilting link member, a feed threaded rod having said nut threadedly engaged thereon, and a least two reed switches disposed at a position close to said nut where the centering rolls are held in the neutral position.

* * * * *